US011555360B2

(12) United States Patent
Callander

(10) Patent No.: US 11,555,360 B2
(45) Date of Patent: Jan. 17, 2023

(54) DRILL FEED SYSTEM

(71) Applicant: Foremost Industries LP, Calgary (CA)

(72) Inventor: Gary R. Callander, Calgary (CA)

(73) Assignee: Foremost Industries LP, Calgary (CA)

( * ) Notice: Subject to any disclaimer, the term of this patent is extended or adjusted under 35 U.S.C. 154(b) by 23 days.

(21) Appl. No.: 17/242,488

(22) Filed: Apr. 28, 2021

(65) Prior Publication Data

US 2022/0349266 A1 Nov. 3, 2022

(51) Int. Cl.
*E21B 19/083* (2006.01)
*E21B 19/086* (2006.01)
*E21B 7/02* (2006.01)

(52) U.S. Cl.
CPC ..... *E21B 19/083* (2013.01); *E21B 7/023* (2013.01); *E21B 19/086* (2013.01)

(58) Field of Classification Search
CPC ..... E21B 7/023; E21B 19/083; E21B 19/086
See application file for complete search history.

(56) References Cited

U.S. PATENT DOCUMENTS 1,658,330 A * 2/1928 Gilman ..... E21B 6/00 173/112
2,130,982 A * 9/1938 Gartin ..... E21B 19/084 173/147
3,867,989 A * 2/1975 Hisey ..... E21B 19/084 173/147
3,874,196 A * 4/1975 Hisey ..... E21B 3/04 175/195
3,907,042 A 9/1975 Halwas et al.
4,368,602 A * 1/1983 Manten ..... E21B 7/027 173/28
5,094,302 A 3/1992 Back
5,269,107 A * 12/1993 Klemm ..... E21B 7/021 52/115
5,927,408 A 7/1999 Dummer
8,671,626 B1 3/2014 Marty
9,410,382 B2 * 8/2016 Reddy ..... E21B 19/16
9,797,196 B2 * 10/2017 Taggart ..... E21B 19/083
10,662,720 B2 * 5/2020 Wurster ..... E21B 19/14
11,199,059 B2 * 12/2021 Jostes ..... E21B 19/14
11,359,446 B2 * 6/2022 Steffenhagen ..... E21B 19/22
11,408,233 B2 * 8/2022 Knijpstra ..... E21B 15/04
2014/0000867 A1 * 1/2014 Andreychuk ..... E21B 15/00 166/77.2
2016/0251914 A1 9/2016 Pusheck
2021/0293131 A1 * 9/2021 Moberg ..... E21B 19/146

FOREIGN PATENT DOCUMENTS

WO 2019104369 A1 6/2019

* cited by examiner

*Primary Examiner* — Shane Bomar
(74) *Attorney, Agent, or Firm* — McDonnell Boehnen Hulbert & Berghoff LLP

(57) ABSTRACT

A gear feed system includes a carrier and a mast mounted on the carrier. The mast includes a pair of panels forming opposing sides of the mast along a central axis of the mast. Each of the pair of panels includes a fixed rack attached to an interior surface of the each of the panels. A gear carrier pair includes a gear, a movable rack assembly, and a cylinder. Each of the gear is coupled to one of the panels and each of the gear couples one of the fixed racks to one of the movable rack assemblies (hoist tubes). The cylinder and the movable rack assembly are coupled via the gear wherein an axial movement of the cylinders causes a corresponding axial displacement of the movable rack assemblies.

13 Claims, 10 Drawing Sheets

DRILL FEED SYSTEM

FIELD

The present disclosure pertains to the field of drill feed systems, and in particular to a direct feed system that reduces maintenance and increases reliability and safety.

BACKGROUND

In a number of fields, a mobile drilling rig may be used for drilling holes in soil. The drilling rig includes a mobile base on which a mast is mounted that may be moved and erected in place to perform drilling. These drilling rigs include a base for the drilling rig and may be mounting on a vehicle, such as a tracked vehicle, a truck, a trailer, or a semi-trailer of a truck. Drilling rigs may be used in the areas of oil and gas exploration, mining, construction, mineral exploration, drilling wells, and other applications.

Drilling rigs include a feed system to insert and remove drill segments as needed when drilling. Existing feed systems use a mast guide or drive system using a chain or rope system to move attached machinery along the mast. They also include gear driven cylinder systems that only utilize one cylinder and pull at a distance offset from the center of drilling.

Prior art solutions suffer from the drawback that feed systems that include chains and cables required a high amount of maintenance in order to ensure smooth, fast operation. In addition, the prior art rack and pinion based feed system does not pull from the center of drilling, resulting in frictional losses and an inability to drill at an angle due to excessive cylinder buckling loads.

Therefore, there is a need for a method and apparatus for an improved drill feed system that obviates or mitigates one or more limitations of the prior art.

This background information is provided to reveal information believed by the applicant to be of possible relevance to the present disclosure. No admission is necessarily intended, nor should be construed, that any of the preceding information constitutes prior art against the present disclosure.

SUMMARY

An object of embodiments of the present disclosure is to provide a rack and pinion based feed system that utilizes cylinders and gear assemblies in tandem to raise and lower hoist tubes. A pair of cylinders drive gears along a rack fixed to the mast so that the gears act as idlers on the mast. The gears also push and pull a hoist tube load so as to act as a drive gear on the drilling loads. Embodiments utilize two cylinders configured to push in the same plane as the drilling load to avoid eccentric loading of the cylinders thereby decreasing the chance of buckling and decreasing friction losses as more cylinder force is transferred to the drilling load. Embodiments have increased reliability and safety and require less maintenance when compared to previous systems.

In accordance with embodiments of the present disclosure, there is provided a gear feed system including a carrier and a mast mounted on the carrier. The mast includes a pair of panels forming opposing sides of the mast along a central axis of the mast. Each of the pair of panels includes a fixed rack attached to an interior surface of the each of the panels. The feed system also includes a gear carrier pair. Each of the gear carriers includes a gear, a plurality of rollers, a structure to house the assembly, a movable rack assembly, and a cylinder. Each of the gear carriers is coupled to one of the panels and each of the gear couples one of the fixed racks to one of the movable rack assemblies. The cylinder and the movable rack assembly are coupled via the gear wherein an axial movement of the cylinders in tandem causes a corresponding axial displacement of the movable rack assemblies. The axial movement of the cylinders of the gear carrier pairs moving in a line with a drilling load.

In further embodiments, the gear carrier includes travel-multiplying gears to cause the axial displacement of the movable rack to be greater than the axial movement of the cylinder. The travel-multiplying gears cause the axial displacement of the movable rack to be two times the axial movement of the cylinder.

In further embodiments, the movable rack assemblies each includes a lift rack fixed to a hoist tube.

Embodiments further include a top drive fixed to the bottom of the hoist tubes.

In further embodiments, each of the gear carrier pairs further includes a plurality of rollers positioned on an exterior surface of the panel opposite the gear carrier. The plurality of rollers hold the gear carrier in proximity to the exterior surface and facilitate the axial movement of the gear carrier along the panel.

In further embodiments, each of the gear carrier pairs further includes a guide positioned between each of the gear carriers and the movable rack assembly. The guide reducing the friction between the gear carrier and the movable rack assembly thereby facilitating the axial movement of the gear carrier along the movable rack assembly.

In further embodiments, each of the cylinders is movable between an upper position a lower position, and everything in between. When the cylinders are in the upper position, the hoist tubes extend above a crown of the mast. When the cylinders are in a middle position, the hoist tubes may begin to protrude through the crown. When the cylinders are in the lower position, the hoist tubes are contained within the mast.

In further embodiments, the mast is coupled to the carrier through a deck, the mast being movable relative to the deck from a generally horizontal attitude to a vertical attitude.

In further embodiments, the deck is mounted on a carrier (truck, tracks, or trailer).

Further embodiments include a remote lubrication assembly placed between the gear carrier pair of the feed system providing lubrication of contact surfaces of the racks and gears.

Further embodiments include a mechanical crossmember linking the gear carrier pairs in a plane perpendicular to the axial movement of the cylinders.

In further embodiments, the axial movement of the cylinders in tandem is driven by a source of flow from a hydraulic source.

Embodiments have been described above in conjunctions with aspects of the present disclosure upon which they can be implemented. Those skilled in the art will appreciate that embodiments may be implemented in conjunction with the aspect with which they are described but may also be implemented with other embodiments of that aspect. When embodiments are mutually exclusive, or are otherwise incompatible with each other, it will be apparent to those skilled in the art. Some embodiments may be described in relation to one aspect, but may also be applicable to other aspects, as will be apparent to those of skill in the art.

BRIEF DESCRIPTION OF THE FIGURES

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Embodiments of the present disclosure provide a rack and pinion based feed system that utilizes tandem cylinders and gear carriers to raise and lower a pair of hoist tubes. Cylinders drive gears along a rack fixed to a mast so that the gears act as idlers on the mast. The gears push and pull a hoist tube load so as to act as a drive gear on drilling loads. Embodiments utilize two cylinders configured to push in the same plane as the drilling load which avoids eccentric loading of the cylinders. The system offers a distinct advantage as it uses both cylinders in the plane of the drilling load to lift the load. As a result, cylinder force lost to friction is minimized and the majority of the force may be used for lifting the load. Using balanced cylinders and gear carriers avoids offset loading situations which creates friction and losses. In addition, configuring the cylinders to pull on center with the drilling load allows for angle drilling due to increased buckling capacity. Embodiments have increased reliability and safety and require less maintenance when compared to previous systems.

Figure 1:
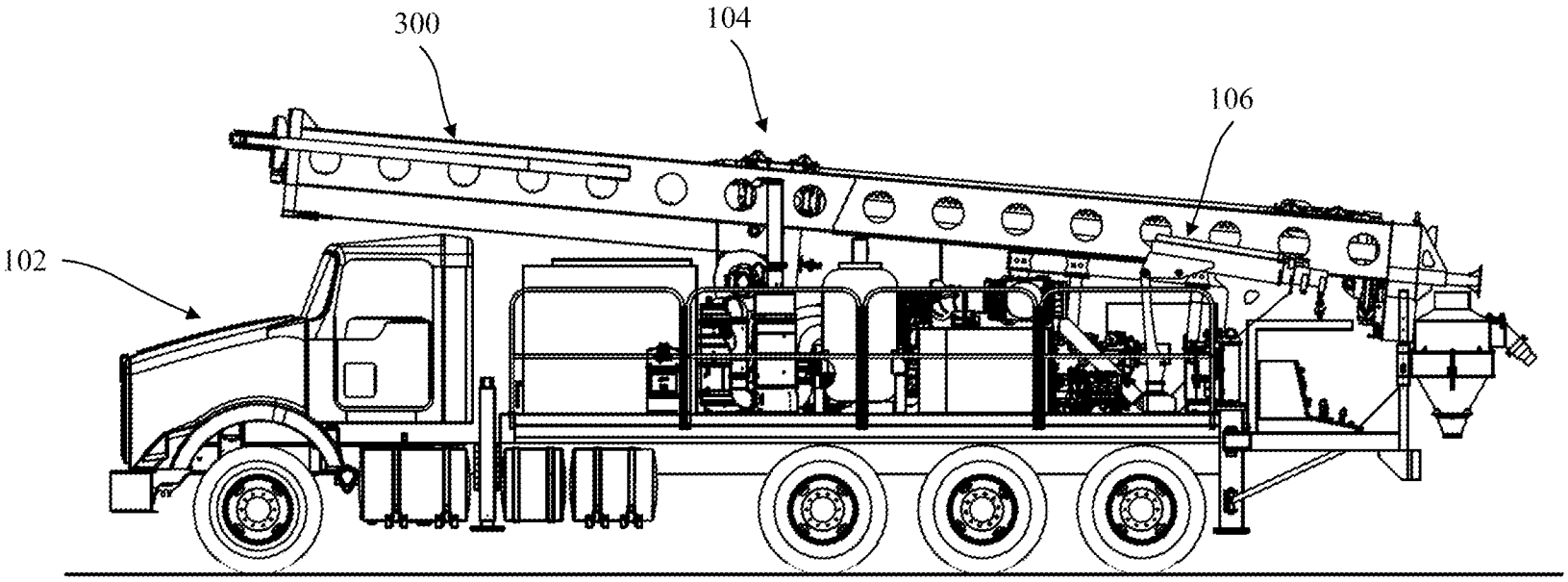
FIG. 1 provides an illustration of a mast mounted on a wheeled vehicle. The mast includes the feed system according to an embodiment.

FIG. 1 illustrates a feed system according to an embodiment illustrating a mast 300, including a gear feed system 104, mounted on a wheeled vehicle 102 with the mast 300 and feed system 104 in a generally horizontal attitude. Feed system 104 may be pivoted on a deck 106 from the horizontal position to a generally vertical attitude for use in the field.

Figure 2:
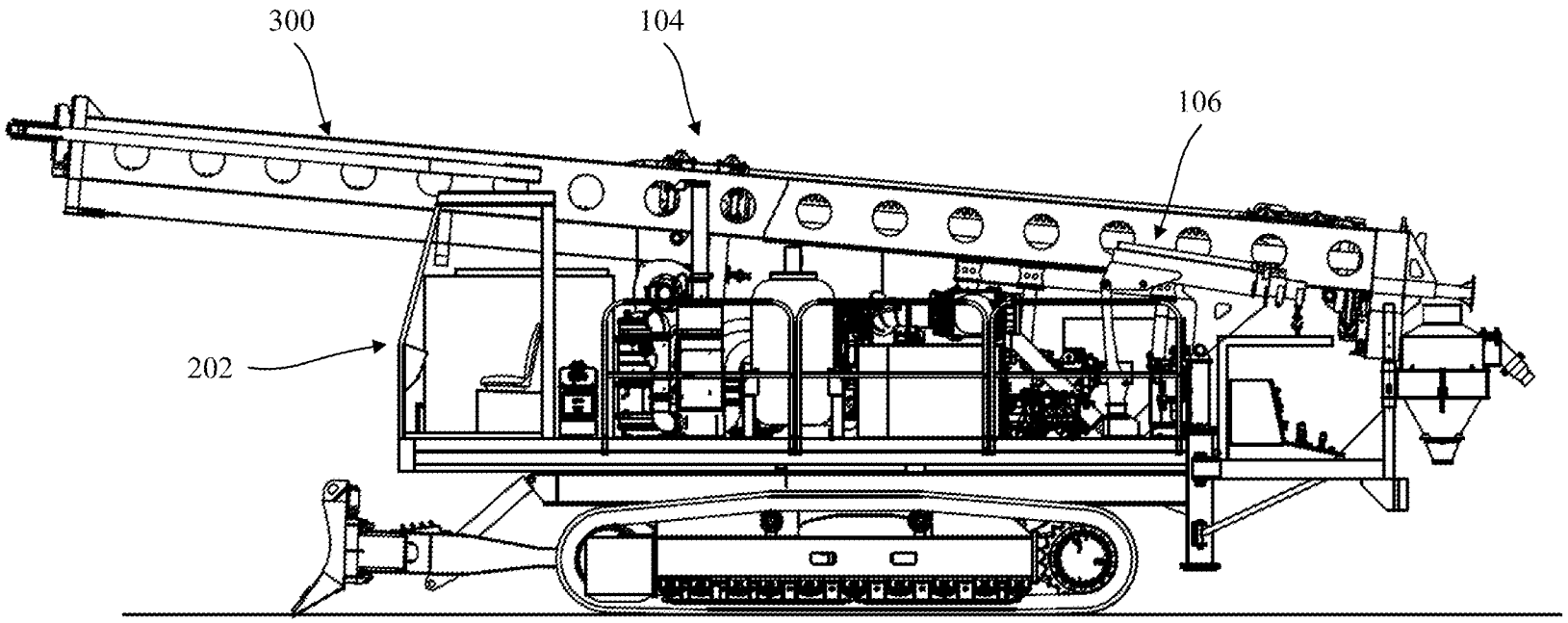
FIG. 2 provides an illustration of a mast mounted on a tracked vehicle. The mast includes the feed system according to an embodiment.

Similarly, FIG. 2 illustrates a feed system according to an embodiment illustrating a mast 300 including a gear feed system 104 mounted on a tracked vehicle 202 with the mast 300 and feed system 104 in a generally horizontal attitude. Feed system 104 may be pivoted on a deck 206 from the horizontal position to a generally vertical attitude for use in the field. Either the wheeled vehicle 102 or the tracked vehicle 202 may be used to transport the mast and feed system in the field to the desired location. Either the wheeled vehicle 102 or the tracked vehicle 202 may be referred to more generally as a carrier, a chassis, or a carrier chassis.

Figure 3:
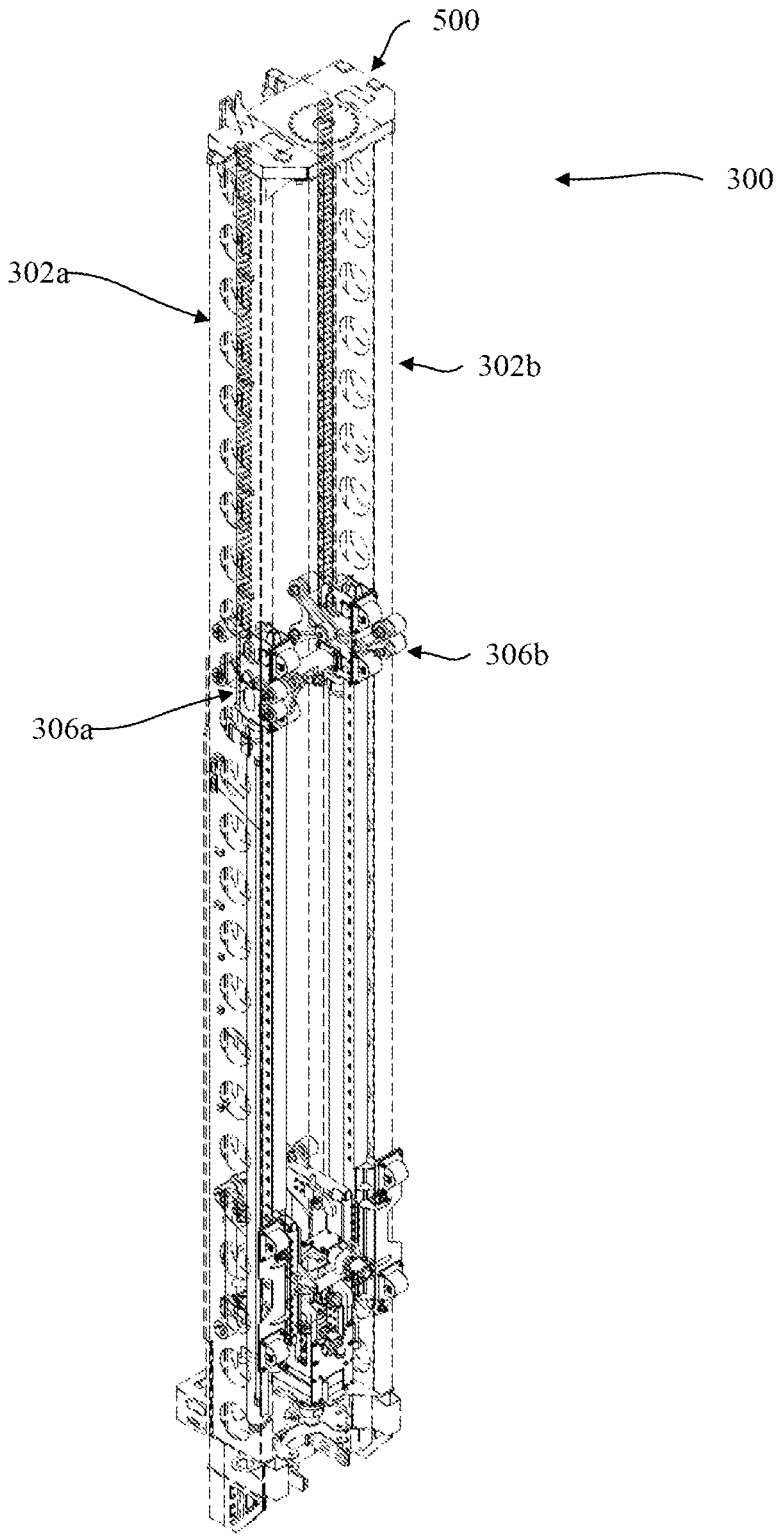
FIG. 3 provides an overall illustration of a mast, and the feed system, according to an embodiment.

FIG. 3 illustrates an overall view of a mast 300 including a feed system illustrating the components and structure of an embodiment. Feed system are mounted on mast 300 which may be installed on a carrier such as wheeled vehicle 102 or tracked vehicle. The mast 300 includes a pair of side panels 302*a* and 302*b* which form opposing sides of the mast 300 along a central axis of the mast. An upper end of the mast 300 is secured by crown 500 which also maintains side panels 302*a* and 302*b* in place and has openings to make room for the hoist tubes of the feed system. Each of the pair of panels includes fixed racks 304*a* and 304*b* attached to an interior surface of each of the panels 302*a* and 302*b*, respectively. A feed system, each includes a gear carrier 306*a* and 306*b*, a movable rack assembly 308*a* and 308*b*, and a cylinder 310*a* and 310*b*. Each of movable rack assembly 308*a* and 308*b* includes a hoist tube 410 with a rack fixed to the hoist tube. This rack may be welded to each hoist tube to form movable rack assembly 308*a* and 308*b*. Each of the gear carriers 306*a* and 306*b* are coupled to one of the side panels 302*a* and 302*b* and each of the gear carriers 306*a* and 306*b* couple one of the fixed racks 304*a* and 304*b* to one of the movable rack assemblies 308*a* and 308*b*. The cylinder 310*a* and 310*b* and the movable rack assembly 308*a* and 308*b* are coupled via the gear carrier wherein an axial movement of the cylinders 310*a* and 310*b* causes a corresponding axial displacement of the movable rack assemblies 308*a* and 308*b*. Each side of the mast is matched to the other so that the assembly of side panel 302*a*, fixed rack 304*a*, gear carrier 306*a*, movable rack assembly 308*a* and cylinder 310*a* is balanced by the assembly of side panel 302*b*, fixed rack 304*b*, gear carrier 306*b*, movable rack assembly 308*b* and cylinder 310*b* around the central axis of the mast. The two cylinders 310*a* and 310*b* push in the same plane as, and in the center of a drilling load. This allows the lifting force on both sides of the mast to match and reduce offset loading situations which create friction and losses in the system.

Figure 4:
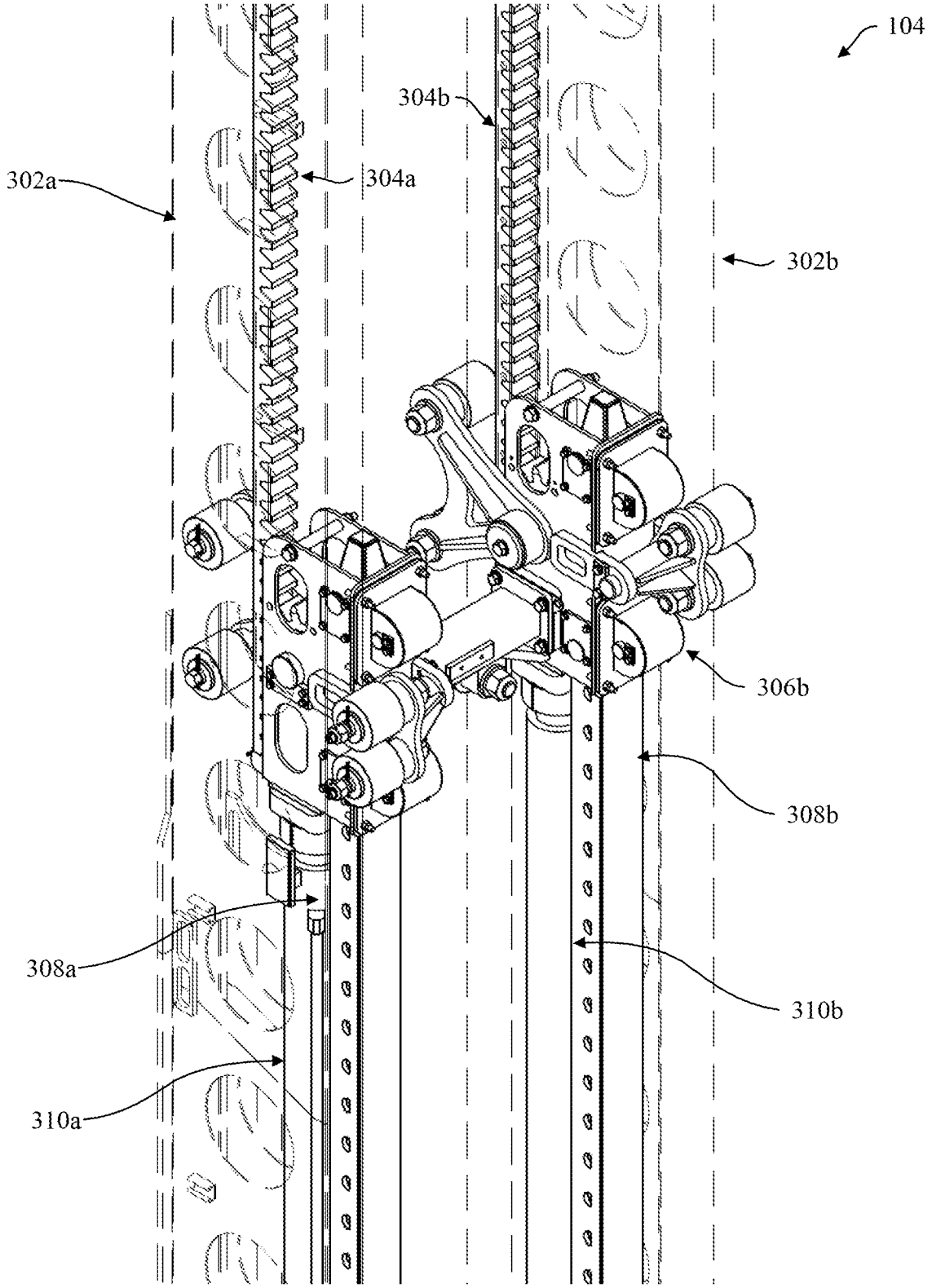
FIG. 4 provides a closeup illustration of a mast and a gear carrier, according to an embodiment.

FIG. 4 provides a close-up illustration of a feed system 104 mounted on a mast. The feed system 104 includes cylinders, a gear carrier, hoist tubes, and racks as illustrated in FIG. 3, according to an embodiment. Cylinders 310*a* and 310*b* are coupled to gear carriers 306*a* and 306*b*, respectively in order to apply balanced axial forces, in the plane of a drilling load, to gear carriers 306*a* and 306*b* to raise and lower the top drive.

Figure 5:
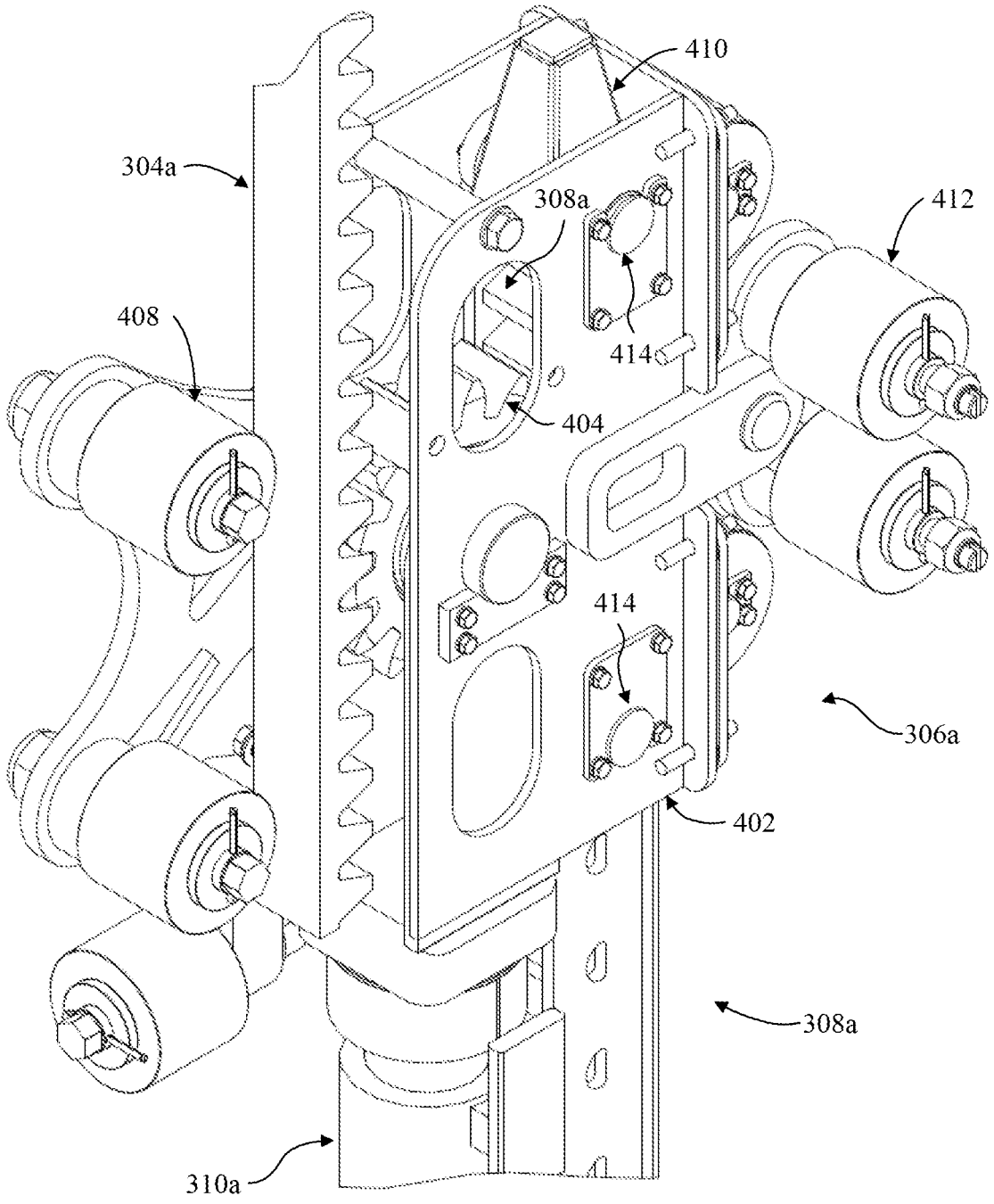
FIG. 5 provides a detailed illustration of a gear carrier, according to an embodiment.
Figure 6:
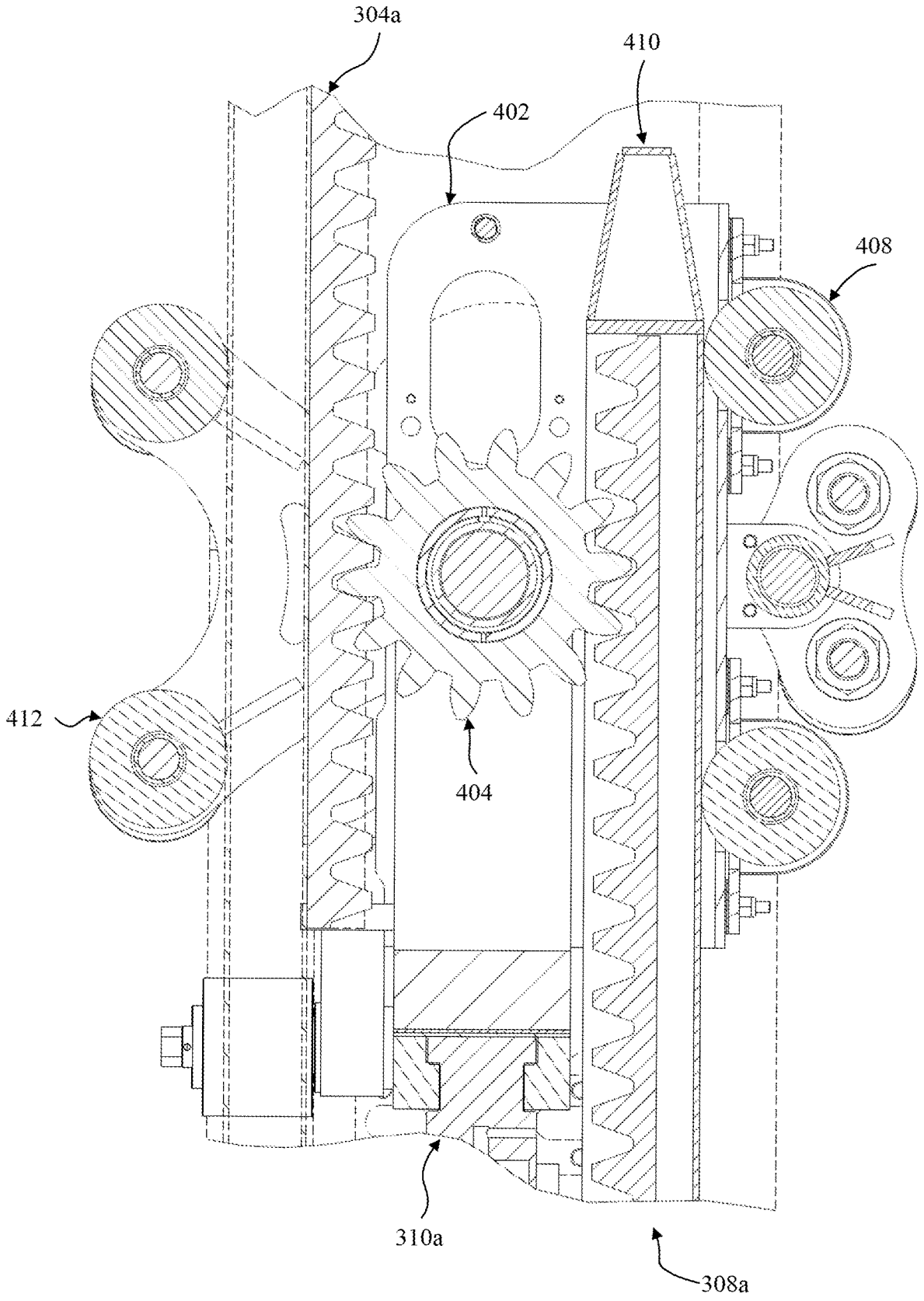
FIG. 6 provides a detailed section view illustration of a gear carrier, according to an embodiment.

FIG. 5 and FIG. 6 illustrate a close-up view of gear carrier 306*a* (or 306*b*) as used in the gear feed system 104 shown in FIG. 3. Gear carrier 306*a* includes a housing 402 enclosing gear 404. Gear 404 is engaged with both fixed rack 304*a* and the rack of movable rack assembly 308*a*. The cylinder 310*a* drives the gear 404 along the fixed rack 304*a*. The gear 404 acts as an idler on the mast except that the gear 404 may push and pull the hoist tube and load, in this case, to drive drilling loads. An upward movement of cylinder 310*a* causes gear carrier 306*a* to move in an upwards direction. The upwards movement of gear carrier 306*a* and the interaction between gear carrier 306*a* and fixed rack 304*a* caused gear 404 to rotate in a counterclockwise direction. The rotation of gear 404 in turn causes movable rack assembly 308*a* to move in an upwards direction. The interaction of gear carrier 306*a*, fixed rack 304*a*, and movable rack assembly 308*a* produces a multiplying gear affect which causes the axial displacement of the movable rack 308*a* to be greater than the axial movement of the cylinder 310*a*. Gear carrier 306*b* has a similar structure but is mirrored across the central axis of the mast.

In embodiments, movable rack assemblies 308*a* and 308*b* include a lift rack fixed to a hoist tube 410.

In embodiments, a top drive is fixed to the bottom of the hoist tubes 410.

In embodiments, each of the gear carriers 306*a* further comprises a plurality of rollers such as 408 and 412. Some of the plurality of rollers 412 are positioned on an exterior surface of the panel 302*a* opposite the gear carrier 306*a*. The plurality of rollers 412 hold the gear carrier 306*a* in proximity to the exterior surface and facilitating the axial movement of the gear carrier 306*a* along the panel 302*a*.

A further plurality of rollers 408 hold the movable rack assembly 308*a* against the gear assembly 306*a*. In addition, one or more low friction guides 414 are placed with gear carriers 306*a* to reduce the friction between each of the gear carriers 306*a* and the movable rack assembly 308*a* thereby facilitating the axial movement of the gear carrier 306*a* along the movable rack assembly 308*a*. Guides 414 may be made of a suitable plastic material or another suitable low friction material. Guides 414 are placed in the direction with theoretical no load, but are included to provide support that may be required due to manufacturing irregularities such as tolerance build up. Guides 414 may be made of a suitable material such as plastic, which could be a nylon plastic material such as Nylatron®.

The rollers 408 and 412 in the gear carriers are placed in the major loading directions and transmit drilling loads to the mast and help to position key components. The rollers 408 and 412 ensure good contact between the gear 404 and the fixed & moving racks. Rollers 408 and 412 provide low friction support in the fore and aft direction, and in the side to side direction. Rollers 408 and 412 also wear less quickly and last longer than pads or spacers. Including rollers in the gear carriers provides a solution that is longer lasting, has less friction, and more load carrying ability when compared to previous implementations and results in a stronger and smoother operating system. Rollers 408 and 412 serve to reduce friction and increase the usable lifespan of guides 414. The guides 414 serve to take up any misalignment between guides 414 and the hoist tubes 410. Where this is little load on components, guides 414 may be used without rollers to reduce friction between components and ensure smooth operation.

Figure 7:
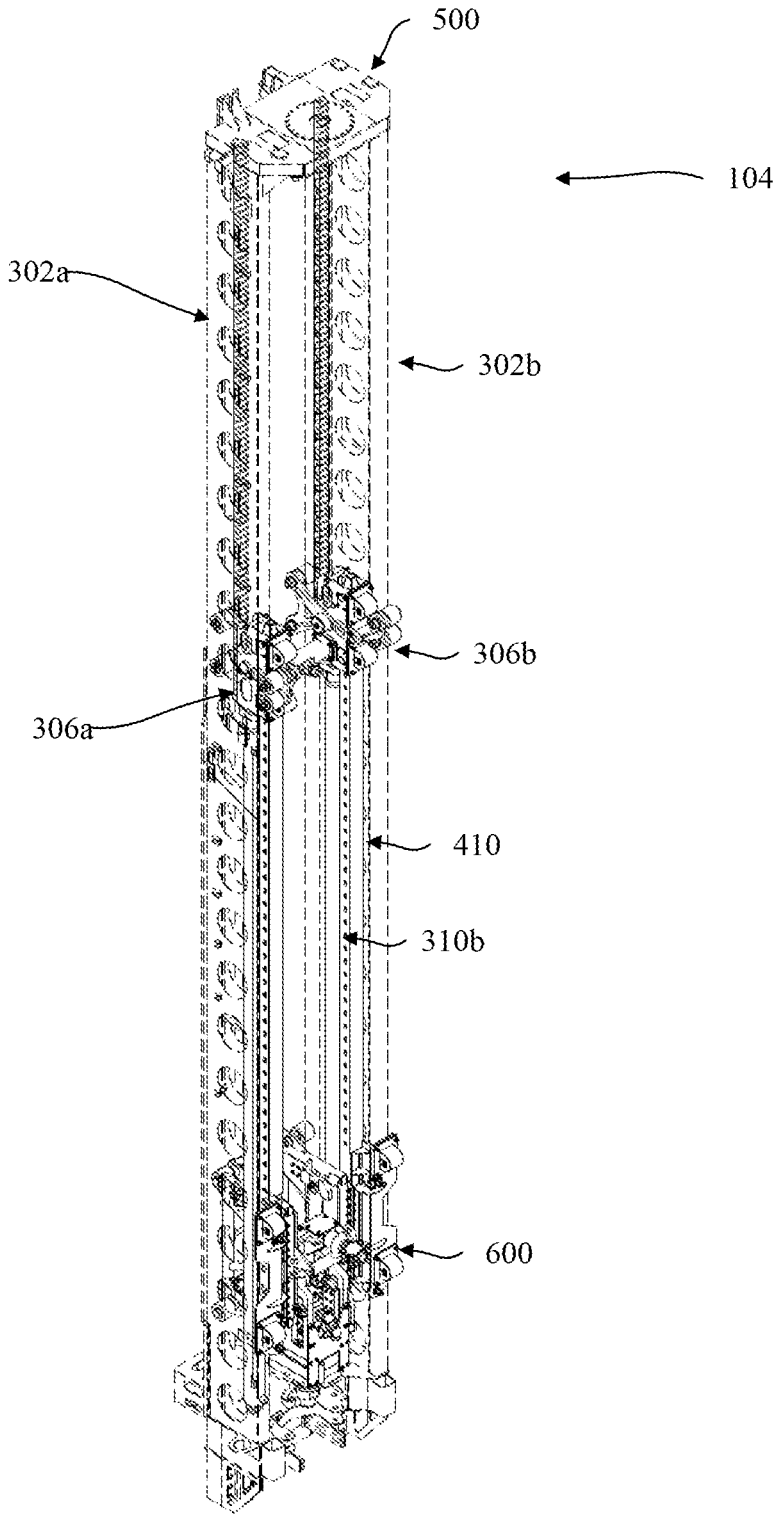
FIG. 7 provides an illustration of a feed system with hoist tubes in a lower position, according to an embodiment.

In embodiment, each of the cylinders 310*a* and 310*b* is movable between an upper position a lower position. Cylinders 310*a* and 310*b* may be used to position the feed system at any arbitrary position between the upper and lower positions. FIG. 7 illustrates when the cylinders 310*a* and 310*b* are in the lower position with hoist tubes 410 contained within the mast. Load 600 is located at the bottom end of the mast.

Figure 8:
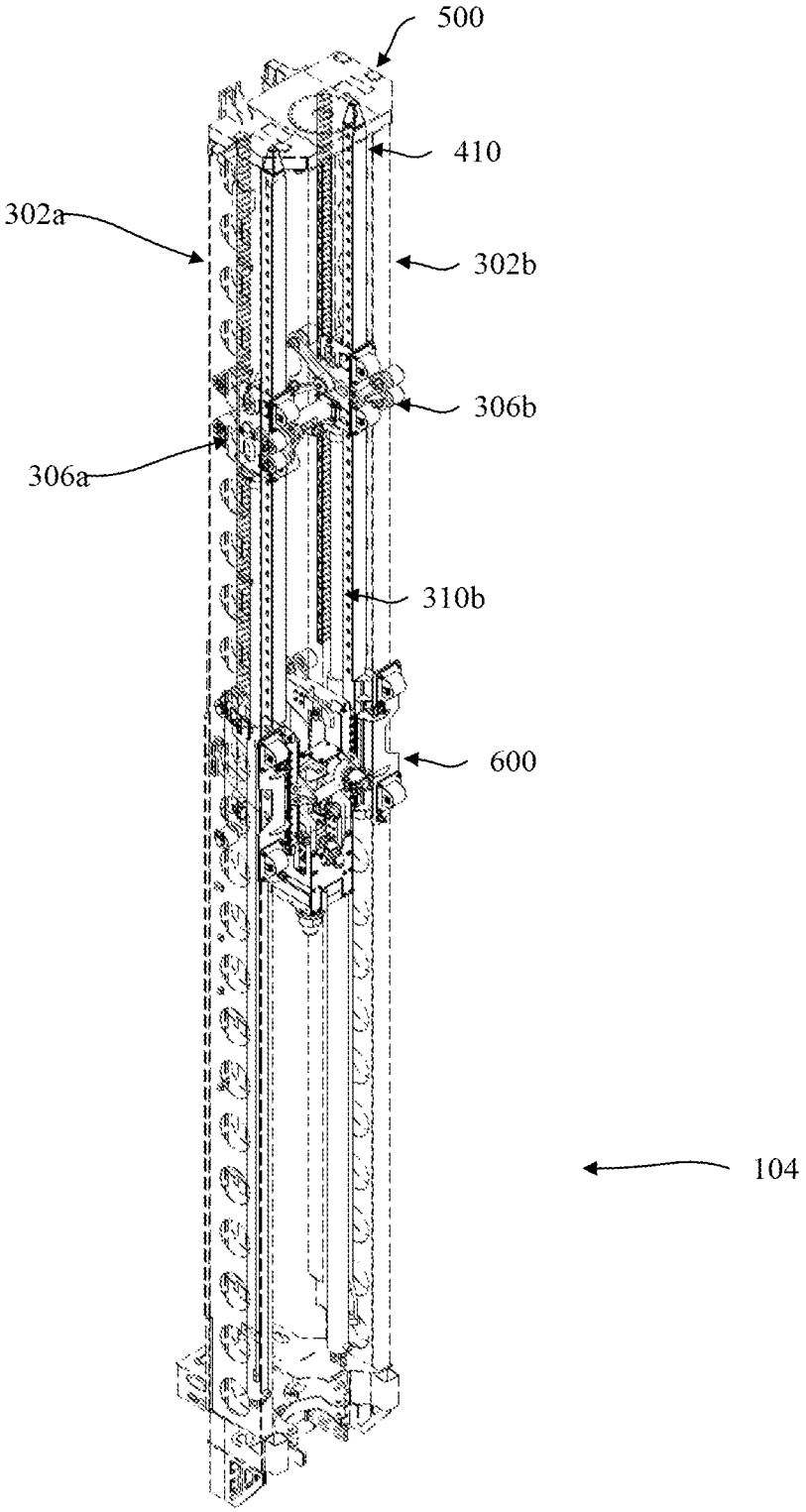
FIG. 8 provides an illustration of a feed system with hoist tubes in a generally middle position, according to an embodiment.

FIG. 8 illustrates when the cylinders 310*a* and 310*b* are in a middle position between the upper position and a lower position. When the cylinders 310*a* and 310*b* are in the middle position, the hoist tubes 410 may be mostly contained within the mast 300 except for upper ends of the hoist tubes 410 protruding just through the crown 500. Load 600 has move to be substantially halfway along the length of the mast.

Figure 9:
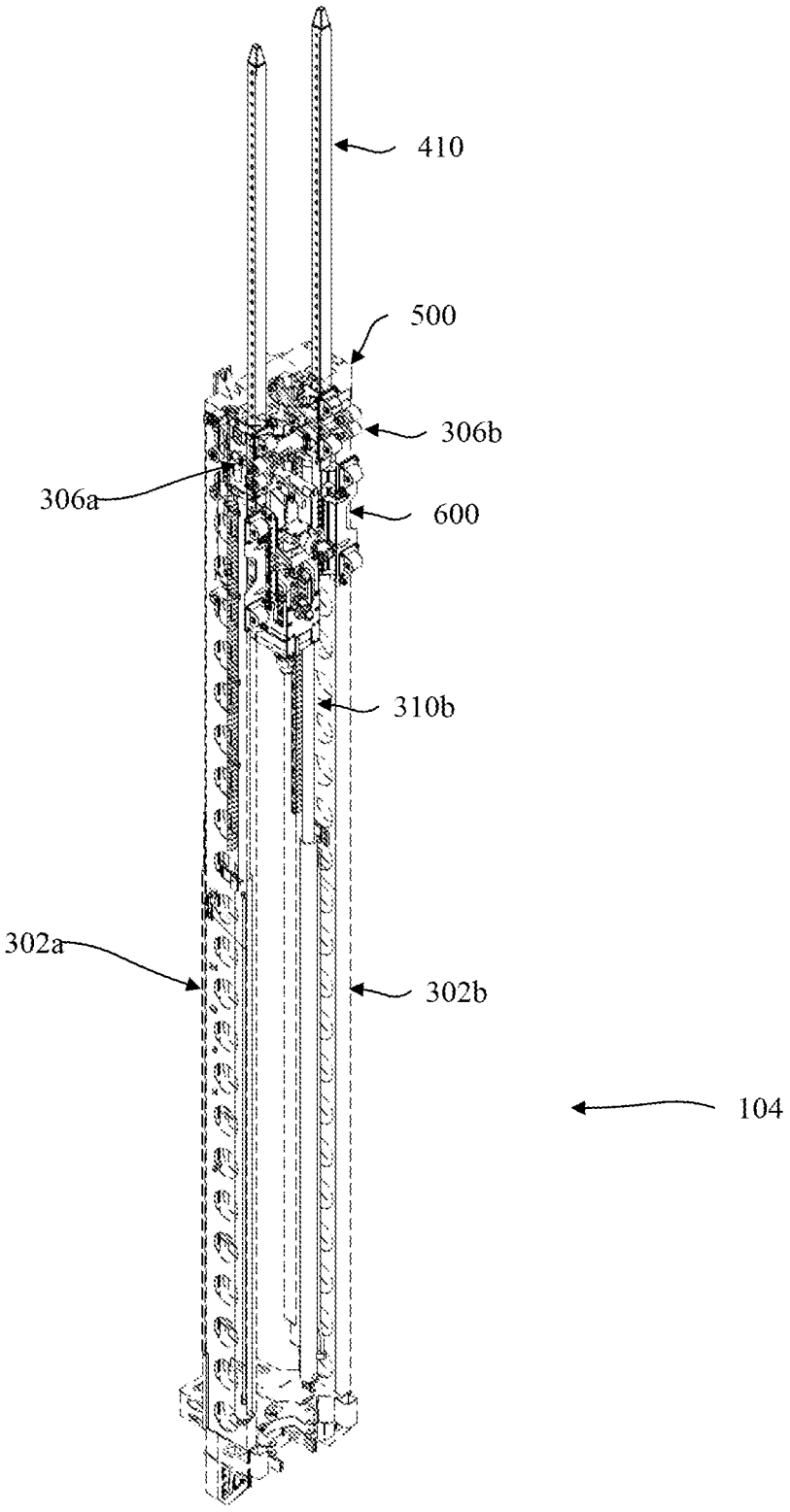
FIG. 9 provides an illustration of a feed system with hoist tubes in an upper position, according to an embodiment.

FIG. 9 illustrates when the cylinders 310*a* and 310*b* are in the upper position. The hoist tubes 410 protrude above the crown 500. When the cylinders 310*a* and 310*b* are in the upper position, only a bottom portion of the hoist tubes 410 are contained within the mast 300. Load 600 is located near the top end of the mast, just below the gear carriers 306*a* and 306*b*. In an example, the top of the hoist tubes 410 protrude approximately 10-12' above the top of the top drive or crown 500 of the mast 300. By extending the hoist tubes 410 above crown 500 allows for the size and weight of mast 300 to be minimized. As there is no weight on the hoist tubes 410 when extended beyond crown 500 the risk of buckling is reduced.

Figure 10:
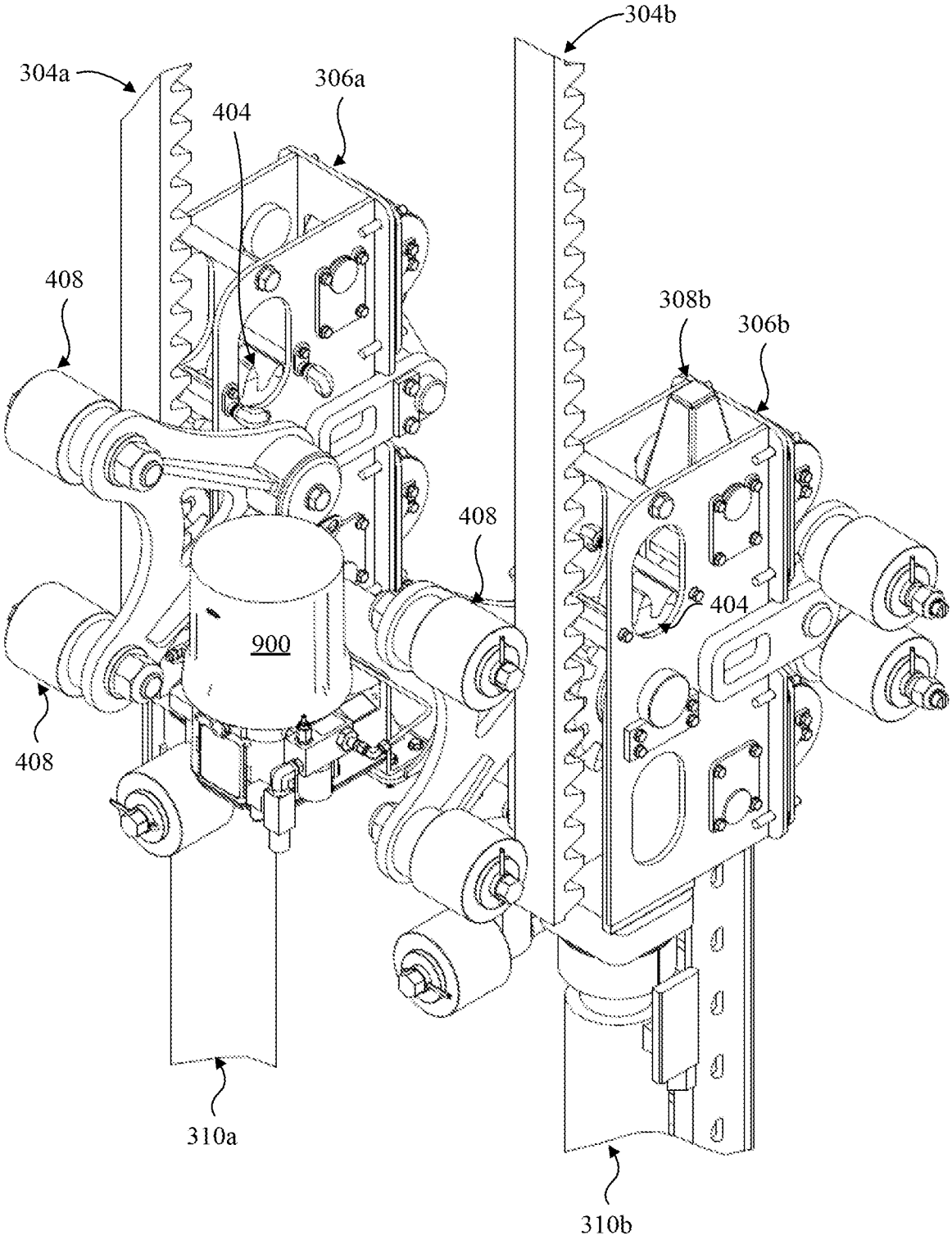
FIG. 10 provides a detailed illustration of a lubrication system to be used with a gear carrier, according to an embodiment.

FIG. 10 illustrates an automatic lubrication assembly 900 that may be added to gear carrier 306 in embodiments. Lubrication assembly 900 allows for the lubrication of the racks and gears using a hands free approach. A reservoir may use an open gear lubricant specifically designed for extended use, adhering to the racks when exposed to the harsh environments. The lubrication system is plumbed into the gear carriers 306*a* and 306*b* and nozzles are directed to directly lubricate and to coat contact surfaces. Contact surfaces include points of contact between gear 404 and their respective fixed racks 304*a* and 304*b*, between gear 404 and their respective movable rack assembly 308*a* and 308*b*, and between the rollers 408 and 412, guides 414, hoist tubes 410, and other points on the mast.

In an embodiment, to lubrication assembly 900 an operator first brings the feed system to the bottom position as illustrated in FIG. 7. The operator then enables the lubrication assembly 900 using a console or similar control interface. The operator then slowly extends the feed system until it is in the upper position as illustrated in FIG. 8. Finally, the operator may disable the lubrication assembly 900 using the console or other user interface.

Embodiments include a direct feed system to raise and lower hoist tubes 410, in a manner that reduces maintenance requirements. Parts that may wear, such as chains and cable, are omitted to increase reliability and safety, and ensure smooth fast operation. Cylinders 310*a* and 310*b* push gear assembly 306*a* and 306*b*, which runs on fixed rack 304*a* and 304*b*. Gear assembly 306*a* and 306*b* are not powered by motors or planetaries, but act as idlers while the cylinders 310*a* and 310*b* push the load, which leads to a simplified system that allows for more control throughout all speed ranges.

The feed system 104 includes cylinders 310*a* and 310*b* attached to gear carriers 306*a* and 306*b* that run on a rack 304*a* and 304*b* welded to the mast 300 and a movable rack assembly 308*a* and 308*b* that include a rack welded to each of hoist tubes 410. A top drive is not shown but is bolted or similarly fixed to the bottom of the hoist tubes 410.

When in use, the pair of cylinders 310*a* and 310*b* may be extended together in tandem to push the gear carriers 306*a* and 306*b* and extend the hoist tubes 410. Similarly, the pair of cylinders 310*a* and 310*b* may be retracted together in tandem to pull the gear carriers 306*a* and 306*b* and retract the hoist tubes 410. In embodiments, both sides of the feed system are linked or controlled to ensure that the pair of cylinders 310*a* and 310*b* are extended together in tandem and that gear carriers 306*a* and 306*b* and the hoist tubes also move in tandem. This ensures that the gear carries 306*a* and 306*b* are linked in a plane perpendicular to the axial movement of the cylinders along the mast 300. The linking may be done using mechanical, electrical, hydraulic, or other means, or combination of means. In embodiments, gear carriers 306*a* and 306*b* may be mechanically linked through a cross member. In embodiments, the pair of cylinders 310*a* and 310*b* may be supplied and driven with the same hydraulic flow and be hydraulically linked. Sensors to detect offsets between the components of both sides of the feed system may be included and form a control loop to ensure that both sides work evenly in tandem within tolerance of the system.

The gear(s) 404 inside the gear carriers 306*a* and 306*b* run on the mast racks 304*a* and 304*b*, respectively, and move the movable rack assembly (including hoist tubes 410) assemblies 308*a* and 308*b* (and therefore top drive) up or down at a 2:1 ratio. The feed system 104 provides a mechanical advantage while allowing all pullback forces to go through the base of the system. This reduces maintenance requirements, increases safety, reduces buckling loads, and allows the implementation of a simple lightweight mast 300. Parts that are most likely to experience wear such as gears 404, the rollers 408 and 412, and guides 414 may be produced oversize in order to maximize the lifespan of the feed system 104. In addition, all wear parts, gears 404, the rollers 408 and 412, and guides 414, are designed for accessibility, and simple and fast replacement in the field.

The gear carriers 306*a* and 306*b* ensure the operation of the feed system 104 and includes rollers 408 and 412, as well as guides 414, to produce smooth operation. Rollers 408 are placed on the exterior surface of the panels 302*a* and 302*b* opposite the gear carriers 306*a* and 306*b*, respectively to ensure that the gear carriers remain in close proximity to the panels. Rollers 412 are placed on the far surface of the movable rack assemblies 308*a* and 308*b*, respectively to ensure that the gear carriers remain in close proximity to the movable racks.

It will be appreciated that, although specific embodiments of the technology have been described herein for purposes of illustration, various modifications may be made without departing from the scope of the technology. The specification and drawings are, accordingly, to be regarded simply as an illustration of the invention as defined by the appended claims, and are contemplated to cover any and all modifications, variations, combinations or equivalents that fall within the scope of the present disclosure. In particular, it is within the scope of the technology to include a computer program product or program element, or a program storage or memory device such as a magnetic or optical wire, tape or disc, or the like, for storing signals readable by a machine, for controlling the operation of a computer according to the method of the technology and/or to structure some or all of its components in accordance with the system of the technology.

Although the present disclosure has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations, or equivalents that fall within the scope of the present invention.

What is claimed is:

1. A gear feed system comprising:

a carrier;

a mast mounted on the carrier, the mast having an open structure and including a pair of panels forming opposing sides of the mast along a central axis of the mast, each of the pair of panels including a fixed rack attached to an interior surface of the each of the panels;

a gear carrier pair, each of the gear carriers including a gear, a movable rack assembly, and a cylinder, each of the gears coupled to one of the panels so that the gear carrier pair is exposed to an environment, each of the gears coupling one of the fixed racks to one of the movable rack assemblies, the cylinder and the movable rack assembly being coupled via the gear wherein an axial movement of the cylinders in tandem causes a corresponding axial displacement of the movable rack assemblies, the axial movement of the cylinders of the gear carrier pair moving inline with a drilling load.

2. The gear feed system of claim 1, wherein each of the gear carrier pair comprises travel-multiplying gears to cause the axial displacement of the movable rack assembly to be two times the axial movement of the cylinder.

3. The gear feed system of claim 1, wherein the movable rack assemblies each comprise a lift rack fixed to a hoist tube.

4. The gear feed system of claim 3, further comprising a top drive fixed to the bottom of the hoist tubes.

5. The gear feed system of claim 1, wherein each of the gear carrier pair further comprises a plurality of rollers, the plurality of rollers positioned on an exterior surface of the panel opposite the gear carrier, the plurality of rollers holding the gear carrier in proximity to the exterior surface and facilitating the axial movement of the gear carrier along the panel.

6. The gear feed system of claim 5, wherein each of the gear carrier pair further comprises a guide, the guide being positioned between the gear carrier and the movable rack assembly, the guide reducing the friction between the gear carrier and the movable rack assembly thereby facilitating the axial movement of the gear carrier along the movable rack assembly.

7. The gear feed system of claim 3, wherein each of the cylinders is movable between an upper position and a lower position, when the cylinders are in the upper position, the hoist tubes extend above a crown of the mast, when the cylinders are in a middle position, an upper end of the hoist tubes begins to protrude through the crown, when the cylinders are in the lower position, the hoist tubes are contained within the mast.

8. The gear feed system of claim 1, wherein the mast is coupled to the carrier through a deck, the mast being movable relative to the carrier from a generally horizontal attitude to a vertical attitude.

9. The gear feed system of claim 1 wherein the carrier is mounted on a vehicle.

10. The gear feed system of claim 1 further comprising a lubrication assembly placed between the gear carriers of the gear carrier pair, the lubrication assembly providing lubrication of contact surfaces of the gear carrier pair.

11. The gear feed system of claim 1 further comprising a mechanical crossmember linking the gear carrier pair in a plane perpendicular to the axial movement of the cylinders.

12. The gear feed system of claim 1 wherein the axial movement of the cylinders in tandem is driven by a source of flow from a hydraulic source.

13. The gear feed system of claim 1 wherein the cylinder directly provides a drive force to each of the gear carrier pair.

* * * * *